US010738265B2

(12) United States Patent
Shearouse et al.

(10) Patent No.: US 10,738,265 B2
(45) **Date of Patent: *Aug. 11, 2020**

(54) LAUNDRY DETERGENT COMPOSITIONS COMPRISING RENEWABLE COMPONENTS

(71) Applicant: The Procter & Gamble Company, Cincinnati, OH (US)

(72) Inventors: William Coffin Shearouse, Cincinnati, OH (US); Daniele Lynn Hibbard, Glendale, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/590,406

(22) Filed: Oct. 2, 2019

(65) Prior Publication Data

US 2020/0032165 A1 Jan. 30, 2020

Related U.S. Application Data

(63) Continuation of application No. 15/706,977, filed on Sep. 18, 2017, now Pat. No. 10,465,145, which is a continuation of application No. 14/994,643, filed on Jan. 13, 2016, now Pat. No. 9,796,948.

(51) Int. Cl.

| | |
|---|---|
| ***C11D 1/22*** | (2006.01) |
| ***C11D 1/72*** | (2006.01) |
| ***C11D 1/75*** | (2006.01) |
| ***C11D 1/83*** | (2006.01) |
| ***C11D 3/50*** | (2006.01) |
| ***C11D 1/29*** | (2006.01) |
| ***C11D 1/66*** | (2006.01) |
| ***C11D 3/20*** | (2006.01) |
| ***C11D 3/37*** | (2006.01) |
| ***C11D 3/386*** | (2006.01) |
| ***C11D 3/00*** | (2006.01) |
| ***C11D 3/22*** | (2006.01) |
| ***C11D 3/30*** | (2006.01) |
| ***C11D 3/43*** | (2006.01) |
| ***C11D 11/00*** | (2006.01) |

(52) U.S. Cl.

CPC ..... *C11D 1/83* (2013.01); *C11D 1/29* (2013.01); *C11D 1/66* (2013.01); *C11D 1/75* (2013.01); *C11D 3/0036* (2013.01); *C11D 3/2044* (2013.01); *C11D 3/222* (2013.01); *C11D 3/30* (2013.01); *C11D 3/3715* (2013.01); *C11D 3/3723* (2013.01); *C11D 3/38618* (2013.01); *C11D 3/38636* (2013.01); *C11D 3/43* (2013.01); *C11D 3/505* (2013.01); *C11D 11/0017* (2013.01); *C11D 1/72* (2013.01)

(58) Field of Classification Search

CPC .... C11D 1/22; C11D 1/72; C11D 1/75; C11D 1/83; C11D 3/042; C11D 3/2041; C11D 3/2065; C11D 3/50

See application file for complete search history.

(56) References Cited

U.S. PATENT DOCUMENTS

| | | | | |
|---|---|---|---|---|
| 5,935,271 | A | 8/1999 | Lappas | |
| 6,017,874 | A | 1/2000 | Lappas | |
| 6,060,441 | A | 5/2000 | Hessel et al. | |
| 7,226,900 | B2 | 6/2007 | Delplancke et al. | |
| 7,326,677 | B2 | 2/2008 | Delplancke | |
| 7,335,630 | B2 | 2/2008 | Delplancke et al. | |
| 7,648,953 | B2 | 1/2010 | Bastigkeit et al. | |
| 7,652,131 | B2 | 1/2010 | Werpy et al. | |
| 7,709,436 | B2 | 5/2010 | Theiler et al. | |
| 7,854,771 | B2 | 12/2010 | Boutique et al. | |
| 7,928,148 | B2 | 4/2011 | Bloom | |
| 7,935,669 | B2 | 5/2011 | Fehr | |
| 7,976,948 | B2 | 7/2011 | Goan | |
| 7,988,883 | B2 | 8/2011 | Wehner | |
| 8,119,586 | B2 | 2/2012 | Scheibel et al. | |
| 8,143,458 | B2 | 3/2012 | Kalagias | |
| 8,153,847 | B2 | 4/2012 | Bloom | |
| 8,177,980 | B2 | 5/2012 | Hilaly et al. | |
| 8,097,579 | B2 | 7/2012 | Danziger et al. | |
| 8,436,046 | B2 | 5/2013 | Fenyvesi et al. | |
| 8,580,720 | B2 | 11/2013 | Boutique | |
| 8,703,688 | B2 | 4/2014 | Sadlowski et al. | |
| 9,579,272 | B2 | 2/2017 | Galleguillos | |
| 9,796,948 | B2 * | 10/2017 | Shearouse | C11D 3/222 |
| 10,323,213 | B2 | 6/2019 | Vockenroth et al. | |
| 2006/0205628 | A1 | 9/2006 | Deinhammer et al. | |
| 2007/0105204 | A1 | 5/2007 | Bao et al. | |
| 2008/0029548 | A1 | 2/2008 | De | |
| 2008/0103340 | A1 | 5/2008 | Binder et al. | |
| 2011/0119841 | A1 | 5/2011 | Bennett et al. | |
| 2013/0053295 | A1 | 2/2013 | Kinoshita et al. | |
| 2013/0284637 | A1 | 10/2013 | Chou et al. | |
| 2014/0039224 | A1 | 2/2014 | Adlaf et al. | |
| 2014/0107380 | A1 | 4/2014 | Bloom et al. | |
| 2015/0065410 | A1 | 3/2015 | Meier et al. | |
| 2015/0132831 | A1 | 5/2015 | Olinski et al. | |
| 2015/0353869 | A1 * | 12/2015 | Stenger | C11D 17/042 510/324 |
| 2018/0002635 | A1 | 1/2018 | Shearouse et al. | |

FOREIGN PATENT DOCUMENTS

| | | | |
|---|---|---|---|
| CA | 2709134 | | 12/2002 |
| JP | 2006161229 | A | 6/2006 |

(Continued)

OTHER PUBLICATIONS

International Search Report for application No. PCT/US2017/012414, dated May 11, 2017, 17 pages.

*Primary Examiner* — Brian P Mruk

(74) *Attorney, Agent, or Firm* — Andrés E. Velarde

(57) ABSTRACT

The present disclosure relates to detergent compositions that comprise renewable components and exhibit good performance, as compared to both traditional detergent formulations that contain non-renewable ingredients and known detergent formulations that contain renewable components.

20 Claims, No Drawings

(56) References Cited

FOREIGN PATENT DOCUMENTS

| | | | |
|---|---|---|---|
| WO | WO9712020 | A1 | 4/1997 |
| WO | WO 0257402 | A1 | 1/2002 |
| WO | WO 2011/060028 | | 5/2011 |
| WO | WO 2011/159418 | A2 | 12/2011 |
| WO | WO 2012/112828 | A1 | 8/2012 |
| WO | WO 2013/092049 | | 7/2013 |
| WO | WO 2014/016134 | A1 | 1/2014 |
| WO | WO 2014/035740 | A1 | 3/2014 |

* cited by examiner

LAUNDRY DETERGENT COMPOSITIONS COMPRISING RENEWABLE COMPONENTS

The instant application is a continuation of Ser. No. 15/706,977, filed on Sep. 18, 2017, now U.S. Pat. No. 10,465,145, which is a continuation of Ser. No. 14/994,643, filed Jan. 13, 2016, now U.S. Pat. No. 9,796,948.

FIELD OF THE INVENTION

The present disclosure relates to detergent compositions that comprise renewable components and exhibit good performance, as compared to both traditional detergent formulations that contain non-renewable ingredients and known detergent formulations that contain renewable components.

BACKGROUND OF THE INVENTION

Liquid laundry detergents have been known in the art for decades. Modern detergents often comprise a blend of synthetic surfactants surfactants that are petroleum-derived, along with any number of additional ingredients, such as builders, water-conditioners, dispersants, soil-release polymers, detersive enzymes, and bleaching agents, to improve cleaning performance and to achieve compositions that are consumer acceptable. Although major strides over decades have moved laundry detergents away from phosphates, many liquid detergents today use synthetic surfactants that, although biodegradable, are petroleum-derived. Many of the surfactants used today are petroleum-based rather than, for example, plant-sourced. There is a need for detergent compositions that include renewable ingredients yet still provide consumer acceptable performance.

It is known in the art to make small substitutions, for example, reduction of builder and/or surfactant levels by increasing enzyme levels, or elimination of phosphates by substitution with carbonate or bicarbonate builders and biodegradable chelants. However, it is problematic to apply this strategy for the replacement of all non-renewable ingredients within a composition, as multiple types of enzymes may need to be combined and stabilized, and additional ingredients beyond the enzymes may be needed to make up for lost performance, (e.g. high levels of optical brightener). A formulation containing a combination of surfactants, including fatty alkyl ether sulfate, linear alcohol ethoxylate, and nonionic sugar surfactant (alkyl polyglycoside), in combination with a multi-enzyme system is known. An eco-friendly liquid laundry detergent composition comprising biodegradable, non-petroleum-derived anionic and nonionic surfactants, with "natural essences" (essential oils or other natural extracts) is known. A liquid laundry detergent composition comprising alkyl polyglycoside (APG) with fatty alcohol sulfate, at least two detersive enzymes, an enzyme stabilization system (e.g., borate and/or citrate and/or calcium salts), d-limonene or other natural essence, water and adjuvant, and having a sustainability index of greater than 3 is also known.

And, a detergent comprising water, sodium dodecylbenzenesulfonate, C14-15 pareth-n, sodium citrate, sodium palm kernelate, MEA-borate, sodium laureth sulfate, dodecylbenzene sulfonic acid, alcohol, propylene glycol, sulfated ethoxylated hexamethylenediamine quaternized, perfume, co-polymer of PEG/vinyl acetate, hydrogenated castor oil, PEI-14 PEG-10/PPG-7 copolymer, ethanolamine, sodium diethylenetriamine pentamethylene phosphate, PEG/PPG-10/2 propylheptyl ether, butylphenyl methylpropional, sorbitol, glycerin, sodium hydroxide, sodium formate, sulfuric acid, alpha-isomethyl ionone, protease, geraniol, linalool, citronellol, tripropylene glycol, glycosidase, phenyl methicone, colorant, sodium acetate, cellulase, phenoxy ethanol, sodium sulfate, silica, and sodium polynaphthalenesulfonate is known.

Overall, the known laundry detergents that contain renewable ingredients do not perform at consumer acceptable levels and do not provide performance that is comparable to that of traditional detergents. There is a need for a laundry detergent that has an increased concentration of renewable components yet has performance comparable to that of traditional detergents.

SUMMARY OF THE INVENTION

The present disclosure attempts to solve one more of the needs by providing a laundry detergent composition comprising: from about 1% to about 20% by weight of alkyl ether sulfate of the formula $R^1$—$(OCH_2CH_2)_x$—O—$SO_3M$, where $R^1$ is a non-petroleum derived, linear or branched fatty alcohol consisting of even numbered carbon chain lengths of from about $C_8$ to about $C_{20}$, and where x is from about 0.5 to about 8, and where M is an alkali metal or ammonium cation; from about 1% to about 15% by weight of fatty alcohol ethoxylate of formula $R^2$—$(OCH_2CH_2)_y$—OH, where $R^2$ is a non-petroleum derived, linear or branched fatty alcohol consisting of even numbered carbon chain lengths of from about $C_{10}$ to about $C_{18}$, and where y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the composition is substantially free of dye and brightener.

The present disclosure also relates to a transparent or translucent liquid laundry detergent composition in a transparent bottle, where the composition comprises from about 1% to about 20% by weight of alkyl ether sulfate of the formula $R^1$—$(OCH_2CH_2)_x$—O—$SO_3M$, where $R^1$ is a non-petroleum derived, linear or branched fatty alcohol consisting of even numbered carbon chain lengths of from about $C_8$ to about $C_{20}$, and where x is from about 0.5 to about 8, and where M is an alkali metal or ammonium cation; from about 1% to about 15% by weight of fatty alcohol ethoxylate of formula $R^2$—$(OCH_2CH_2)_y$—OH, where $R^2$ is a non-petroleum derived, linear or branched fatty alcohol consisting of even numbered carbon chain lengths of from about $C_{10}$ to about $C_{18}$, and where y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the transparent or translucent composition has about 50% transmittance or greater of light using 1 cm cuvette at wavelength of 410-800 nanometers; and where the transparent bottle has light transmittance of greater than 25% at wavelength of about 410-800 nm.

The present disclosure also relates to a method of laundering colored fabric which comprises the steps of: providing a detergent composition where the composition comprises from about 1% to about 20% by weight of alkyl ether sulfate of the formula $R^1$—$(OCH_2CH_2)_x$—O—$SO_3M$, where $R^1$ is a non-petroleum derived, linear or branched fatty alcohol consisting of even numbered carbon chain lengths of from about $C_8$ to about $C_{20}$, and where x is from about 0.5 to about 8, and where M is an alkali metal or ammonium cation; from about 1% to about 15% by weight of fatty alcohol ethoxylate of formula $R^2$—$(OCH_2CH_2)$—OH, where $R^2$ is a non-petroleum derived, linear or branched fatty alcohol consisting of even numbered carbon chain lengths of from about $C_{10}$ to about $C_{18}$, and where y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the composition is substantially free of brightener and monoethanolamine; diluting a dose of the detergent composition in water by a factor of greater than 500 to obtain a wash liquor which comprises 0.8 to 0.035 g/L of surfactant; washing the colored fabric with the wash liquor so formed, where the chlorine scavenging efficiency is at least about 90% at an initial free chlorine concentration of 2.4 ppm.

DETAILED DESCRIPTION OF THE INVENTION

Features and benefits of the various embodiments of the present invention will become apparent from the following description, which includes examples of specific embodiments intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, articles such as "a" and "an" when used in a claim, are understood to mean one or more of what is claimed or described.

As used herein, the terms "include", "includes" and "including" are meant to be non-limiting.

The term "renewable" is synonomous with the terms "biobased," "sustainable," "sustainably derived," or "from sustainable sources" and means bio-derived (derived from a renewable resource, e.g., plants) or "non-geologically derived." "Geologically derived" means derived from, for example, petrochemicals, natural gas, or coal. "Geologically derived" materials cannot be easily replenished or regrown (e.g., in contrast to plant- or algae-produced oils).

As used herein, the term "renewable component" refers to a component that is derived from renewable feedstock and contains renewable carbon. A renewable feedstock is a feedstock that is derived from a renewable resource, e.g., plants, and non-geologically derived. A material may be partially renewable (less than 100% renewable carbon content, from about 1% to about 50% renewable carbon content) or 100% renewable (100% renewable carbon content). A renewable material may be blended with a nonrenewable material.

"Renewable carbon" may be assessed according to the "Assessment of the Biobased Content of Materials" method, ASTM D6866.

As used herein, the term "natural oils" means oils that are derived from plant or algae matter (also referred to as renewable oils). Natural oils are not based on kerosene or other fossil fuels. The term "oils" include fats, fatty acids, waste fats, oils, or mixtures thereof. Natural oils include, but are not limited to, coconut oil, babassu oil, castor oil, algae byproduct, beef tallow oil, borage oil, camelina oil, Canola® oil, choice white grease, coffee oil, corn oil, *Cuphea Viscosissima* oil, evening primrose oil, fish oil, hemp oil, hepar oil, jatropha oil, *Lesquerella Fendleri* oil, linseed oil, *Moringa Oleifera* oil, mustard oil, neem oil, palm oil, perilla seed oil, poultry fat, rice bran oil, soybean oil, stillingia oil, sunflower oil, tung oil, yellow grease, cooking oil, and other vegetable, nut, or seed oils. A natural oil typically includes triglycerides, free fatty acids, or a combination of triglycerides and free fatty acids, and other trace compounds.

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations. Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

As used herein the term "dye" includes aesthetic dyes that modify the aesthetics of the cleaning composition as well as dyes and/or pigments that can deposit onto a fabric and alter the tint of the fabric. Dyes include colorants, pigments, and hueing agents.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated. It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Detergent Composition Comprising Renewable Components

As used herein the phrase "detergent composition" or "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, single-phase or multi-phase unit dose, pouch, tablet, gel, paste, bar, or flake.

The present disclosure relates to a detergent composition for laundering fabrics that comprises renewable components and exhibits good performance, such as stain removal and whiteness maintenance. The detergent compositions disclosed herein may contain from about 1%, or from about 5%, or from about 10%, or from about 20% or from about 30%, of from about 40% or from about 50%, to about 40%, or to about 50%, or to about 60% or to about 70% or to about 80% or to about 90%, or to about 100% by weight of renewable components.

The compositions may have a at least 50% transmittance of light using a 1 centimeter cuvette, at a wavelength of 410-800 nanometers, or 570-690 nanometers, where the composition is substantially free of dyes.

Alternatively, transparency of the composition may be measured as having an absorbency in the visible light wavelength (about 410 to 800 nm) of less than 0.3, which is in turn equivalent to at least 50% transmittance using cuvette and wavelength noted above. For purposes of the disclosure, as long as one wavelength in the visible light range has greater than 50% transmittance, it is considered to be transparent/translucent.

The laundry detergent composition(s) of the present disclosure comprise alkyl ether sulfate derived from renewable fatty alcohol; fatty alcohol ethoxylate derived from renewable fatty alcohol; amine oxide; one or more cleaning polymer(s); 1,2-propanediol; and water; where the composition is substantially free of dye and brightener. The laundry detergent composition(s) may be a liquid.

Alkyl Ether Sulfate

The detergent compositions described herein may comprise from about 1% to about 20%, or from about 1% to about 18%, or from about 2% to about 15%, or from about 3% to about 10% by weight the composition, of one or more alkyl ether sulfates (also known as alcohol ether sulfate) derived from renewable fatty alcohol.

The detergent compositions described herein may comprise one or more alkyl ether sulfates of the formula $R^1$—$(OCH_2CH_2)_x$—O—$SO_3M$, where $R^1$ is a non-petroleum derived, linear or branched fatty alcohol consisting of even numbered carbon chain lengths of from about $C_8$ to about $C_{20}$, or from about $C_8$ to about $C_{16}$, or from about $C_{10}$ to about $C_{14}$, or about $C_{12}$, and where x is from about 0.5 to about 8, or x is from about 0.5 to about 5, or x is from about 0.5 to about 3, and where M is an alkali metal, ammonium, alkyl ammonium, or alkanol ammonium cation. M may be an alkali metal or ammonium cation.

The fatty alcohol portion of the alkyl ether sulfate ($R^1$) is derived from a renewable source (e.g., animal or plant derived) rather than geologically derived (e.g., petroleum derived). Fatty alcohols derived from a renewable source may be referred to as natural fatty alcohols. Natural fatty alcohols have an even number of carbon atoms with a single alcohol (—OH) attached to the terminal carbon. The fatty alcohol portion of the surfactant ($R^1$) may comprise distributions of even number carbon chains, e.g., C12, C14, C16, C18, and so forth.

The fatty alcohol portion of the alkyl ether sulfate ($R^1$) may be derived from a natural oil. The natural oil may be selected from the group consisting of coconut oil, palm kernel oil, palm oil, or a mixture thereof. These oils contain the greatest concentration of triglycerides and free fatty acids having chain lengths ranging from C10 to C18, particularly C10 to C16, which are especially useful in detergent. The natural oil may comprise triglycerides and free fatty acids in the C10 to C18 chain length or in the C10 to C16 chain length.

It is understood that the alkyl ether sulfates described herein are typically not single compounds as suggested by the formula $R^1$—$(OCH_2CH_2)_x$—O—$SO_3M$, but rather, alkyl ether sulfates comprise a mixture of several homologs having varied polyalkylene oxide chain length and molecular weight. For example, ethoxylated alcohol sulfate derived from conventional potassium hydroxide-catalyzed ethoxylation of the alcohol with 1, 2, and 3 moles of ethylene oxide, respectively, is not a single compound containing 1, 2, or 3 ($CH_2CH_2O$) units as the formula may suggest. Instead, the ethoxylated alcohol sulfate is a mixture of several homologs whose total ethylene oxide units vary from 0 to 10. It is understood, therefore, that ethoxylated alcohol sulfate may comprise some non-ethoxylated (unreacted) alkyl sulfate.

The compositions disclosed herein may comprise one or more than one type of alkyl ether sulfate; the different types of alkyl ether sulfate may differ in carbon chain length and/or degree of ethoxylation. The compositions disclosed herein may comprise a mixture of alkyl ether sulfates, where the mixture may have an average (arithmetic mean) carbon chain length within the range of about 12 to about 16 carbon atoms, or an average carbon chain length of about 12 carbon atoms, and an average (arithmetic mean) degree of ethoxylation of from about 1 mol to 4 mols of ethylene oxide, or an average (arithmetic mean) degree of ethoxylation of 1.0 mols of ethylene oxide.

Alkyl ether sulfates are generally available as salts e.g., sodium alkyl ether sulfates. Commercially available alkyl ether sulfates include the CALFOAM® alcohol ether sulfates from Pilot Chemical, the EMAL®, LEVENOL® and LATEMAL® products from Kao Corporation, and the POLYSTEP® products from Stepan, most of these with fairly low EO content (e.g., average 3 or 4-EO). Alternatively alkyl ether sulfates may be prepared by sulfonation of alcohol ethoxylates (i.e., nonionic surfactants), for example, when the commercial alkyl ether sulfate having the desired chain length and EO content is not easily found, but the alcohol ethoxylate is available.

Fatty Alcohol Ethoxylate

The detergent compositions described herein may comprise from about 1% to about 15%, or from about 1% to about 12%, or from about 2% to about 10%, or from about 3% to about 9% by weight the composition, of one or more fatty alcohol ethoxylates derived from renewable fatty alcohol.

The detergent compositions described herein may comprise one or more fatty alcohol ethoxylates of formula $R^2$—$(OCH_2CH_2)_y$—OH, where $R^2$ is a non-petroleum derived, linear or branched fatty alcohol consisting of even numbered carbon chain lengths of from about $C_{10}$ to about $C_{18}$, or from about $C_{12}$ to about $C_{16}$, or from about $C_{12}$ to about $C_{14}$, or about $C_{16}$, and where y is from about 0.5 to about 15, or from about 2 to about 12, or from about 3 to about 10.

The fatty alcohol portion of the fatty alcohol ethoxylate ($R^2$) is derived from a renewable source (e.g., animal or plant derived) rather than geologically derived (e.g., petroleum derived). Fatty alcohols derived from a renewable source may be referred to as natural fatty alcohols. Natural fatty alcohols have an even number of carbon atoms with a single alcohol (—OH) attached to the terminal carbon. The fatty alcohol portion of the surfactant ($R^2$) may comprise distributions of even number carbon chains, e.g., C12, C14, C16, C18, and so forth.

The fatty alcohol portion of the fatty alcohol ethoxylate ($R^2$) may be derived from a natural oil. The natural oil may be selected from the group consisting of coconut oil, palm kernel oil, palm oil, or a mixture thereof. These oils contain the greatest concentration of triglycerides and free fatty acids having chain lengths ranging from C10 to C18, particularly C10 to C16, which are especially useful in detergent. The natural oil may comprise triglycerides and free fatty acids in the C10 to C18 chain length or in the C10 to C16 chain length.

It is understood that the fatty alcohol ethoxylates described herein are typically not single compounds as suggested by the formula $R^2$—$(OCH_2CH_2)_y$—OH, but rather, fatty alcohol ethoxylates comprise a mixture of several homologs having varied polyalkylene oxide chain length and molecular weight. For example, fatty alcohol ethoxylate derived from conventional potassium hydroxide-catalyzed ethoxylation of the alcohol with 1, 2, and 3 moles of ethylene oxide, respectively, is not a single compound containing 1, 2, or 3 ($CH_2CH_2O$) units as the formula may suggest. Instead, the fatty alcohol ethoxylate is a mixture of several homologs whose total ethylene oxide units vary from 0 to 10. It is understood, therefore, that fatty alcohol ethoxylate may comprise some non-ethoxylated (unreacted) fatty alcohol.

The compositions disclosed herein may comprise one or more than one type of fatty alcohol ethoxylate; the different types of fatty alcohol ethoxylates may differ in carbon chain length and/or degree of ethoxylation. The compositions disclosed herein may comprise a mixture of fatty alcohol ethoxylates, where the mixture may have an average (arithmetic mean) carbon chain length within the range of about 12 to about 16 carbon atoms, or an average carbon chain length of about 12 carbon atoms, and an average (arithmetic mean) degree of ethoxylation of from about 1 mol to about 15 mols of ethylene oxide, or from about 3 mol to about 10 mols of ethylene oxide.

Amine Oxide

The detergent compositions described herein may comprise from about 0.1% to about 5%, or from about 1% to about 4%, or from about 1% to about 3% by weight the composition, of one or more amine oxide surfactants.

Amine oxides are materials that are often referred to in the art as "semi-polar" nonionics. Amine oxides have the formula: $R^3N(O)(CH_3)_2$. In this formula, $R^3$ is saturated or unsaturated, linear or branched, and may contain from about 8 to about 20, or from 10 to about 16 carbon atoms, or $R^3$ is a $C_{12}$-$C_{16}$ primary alkyl. The detergent compositions described herein may comprise $C_{12}$-$C_{14}$ dimethyl amine oxide. $C_{12}$-$C_{14}$ dimethyl amine oxide is supplied by Procter & Gamble Chemicals, Cincinnati, USA.

Amine oxide may be derived from renewable sources, such as natural fatty alcohols. Amine oxide is believed to work synergistically with anionic surfactants to remove stains.

Cleaning Polymer

The detergent compositions described herein may comprise from about 0.1% to about 5%, or from about 1% to about 4%, or from about 1% to about 3% by weight the composition, of one or more cleaning polymers.

The detergent composition may comprise one or more cleaning polymers. Examples are carboxymethylcellulose, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid copolymers.

The detergent composition may comprise one or more amphiphilic cleaning polymers, such as the compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n=from 20 to 30, and x=from 3 to 8, or sulphated or sulphonated variants thereof.

The detergent composition may comprise one or more alkoxylated polyalkylenimines or one or more alkoxylated polyamines.

The detergent composition may comprise amphiphilic alkoxylated grease cleaning polymers which have balanced hydrophilic and hydrophobic properties, such that they remove grease particles from fabrics and surfaces. The amphiphilic alkoxylated grease cleaning polymers may comprise a core structure and a plurality of alkoxylate groups attached to that core structure. These may comprise alkoxylated polyalkylenimines, for example, having an inner polyethylene oxide block and an outer polypropylene oxide block. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF.

The detergent compositions described herein may comprise alkoxylated polycarboxylates. Alkoxylated polycarboxylates such as those prepared from polyacrylates may be useful herein to provide additional grease removal performance. Chemically, these materials comprise polyacrylates having one ethoxy side-chain per every 7-8 acrylate units. The side-chains are of the formula —$(CH_2CH_2O)_m$ $(CH_2)_n$ $CH_3$ where m is 2-3 and n is 6-12. The side-chains are ester-linked to the polyacrylate backbone to provide a comb polymer type structure. The molecular weight can vary, but is typically in the range of about 2000 to about 50,000.

The detergent compositions described herein may comprise amphilic graft co-polymers. Suitable amphilic graft co-polymer include an amphilic graft co-polymer comprising (i) a polyethyelene glycol backbone; and (ii) and at least one pendant moiety selected from polyvinyl acetate, polyvinyl alcohol, and mixtures thereof. A commercially available example of an amphilic graft co-polymer is Sokalan® HP22, supplied from BASF. Suitable polymers include random graft copolymers, for example, a polyvinyl acetate grafted polyethylene oxide copolymer having a polyethylene oxide backbone and multiple polyvinyl acetate side chains. The molecular weight of the polyethylene oxide backbone may be about 6000 and the weight ratio of the polyethylene oxide to polyvinyl acetate may be from about 40 to about 60, and the polyethylene oxide backbone may have no more than 1 grafting point per 50 ethylene oxide units.

The detergent compositions of the present disclosure may contain one or more carboxylate polymers, such as a maleate/acrylate random copolymer or polyacrylate homopolymer. The carboxylate polymer may be a polyacrylate homopolymer having a molecular weight of from 4,000 Da to 9,000 Da, or from 6,000 Da to 9,000 Da.

The detergent compositions of the present disclosure may contain one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group. Suitable soil release polymers include polyester soil release polymers such as Repel-o-tex polymers, including Repel-o-tex® SF, SF-2 and SRP6 supplied by Rhodia. Other suitable soil release polymers include Texcare® polymers, including Texcare® SRA100, SRA300, SRN100, SRN170, SRN240, SRN300 and SRN325 supplied by Clariant. Other suitable soil release polymers are Marloquest® polymers, such as Marloquest® SL supplied by Sasol.

The detergent compositions of the present disclosure may contain one or more cellulosic polymers. Suitable cellulosic polymers include alkyl cellulose, alkyl alkoxyalkyl cellulose, carboxyalkyl cellulose, alkyl carboxyalkyl cellulose. The cellulosic polymer(s) may be selected from the group consisting of carboxymethyl cellulose, methyl cellulose, methyl hydroxyethyl cellulose, methyl carboxymethyl cellulose, and mixtures thereof. The carboxymethyl cellulose may have a degree of carboxymethyl substitution from about 0.5 to about 0.9 and a molecular weight of from about 100,000 Da to about 300,000 Da.

Solvent

The detergent compositions described herein may comprise from about 1% to about 15%, or from about 1% to about 12%, or from about 1% to about 10% by weight the composition, of one or more solvents. Liquid detergent compositions and other forms of detergent compositions that include a liquid component (such as liquid-containing unit dose detergent compositions) may contain one or more solvents and water.

Suitable solvents include lipophilic fluids, including siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, and mixtures thereof. Low molecular weight primary or secondary alcohols exemplified by methanol, ethanol, propanol, and isopropanol are also suitable. Monohydric alcohols may be used in some examples for solubilizing surfactants, and polyols such as those containing from 2 to about 6 carbon atoms and from 2 to about 6 hydroxy groups (e.g., ethylene glycol, glycerine, and 1,2-propanediol) may also be used.

Suitable solvents include ethanol, diethylene glycol (DEG), 2-methyl-1,3-propanediol (MPD), dipropylene glycol (DPG), oligamines (e.g., diethylenetriamine (DETA), tetraethylenepentamine (TEPA)), glycerine, propoxylated glycerine, ethoxylated glycerine, ethanol, 1,2-propanediol (also referred to as propylene glycol), diethylene glycol, dipropylene glycol, 1,3-propanediol, 2,3-butanediol, cellulosic ethanol, renewable propylene glycol, renewable dipropylene glycol, renewable 1,3-propanediol, other solvents used in detergent formulations, and mixtures thereof.

The detergent compositions described herein may comprise from about 1% to about 15% by weight of a solvent comprising 1,2-propanediol, renewable 1,2-propanediol, 1,3-propanediol, renewable 1,3-propanediol, ethanol, cellulosic ethanol, or mixtures thereof. The detergent compositions described herein may comprise from about 1% to about 15% by weight of a solvent comprising 1,2-propanediol, renewable 1,2-propanediol, ethanol, cellulosic ethanol, or mixtures thereof. Biobased propylene glycol is described in U.S. Pat. No. 7,928,148 and available from ADM. Biobased 1,3-propanediol is described in U.S. Pat. No. 8,436,046 and available from DuPont Tate & Lyle Bio Products Company, LLC.

Biobased propylene glycol may be made by catalytic hydrogenolysis (hydro cracking) of polyol. Catalytic hydrogenolysis is a process whereby polyols such as sugars, glycerol, and/or glycols are reacted with hydrogen to produce other polyols. The polyols so produced often comprise a mixture of several polyols having a lower average molecular weight than the starting material. The conversion of polyols, such as sugars and glycerol, to polyhydric alcohols, such as propylene glycol and ethylene glycol, by hydrogenolysis or by hydrocracking results in the formation of not only these alcohols, but several other products, such as 1,2-butanediol, 1,3-butanediol, 1,4-butanediol, 2,3-butanediol and 2,4-pentanediol. These products are recovered as impurities with the propylene glycol and ethylene glycol. For example, in hydrocracking of higher carbohydrates, such as sorbitol, to produce propylene glycol, typically 3-5% by weight of 2,3-butanediol is produced in addition to 1,2-butanediol, ethylene glycol, and 1,3-butanediol. U.S. Pat. No. 7,928,148 (citing U.S. Pat. No. 4,935,102) discloses a list of polyols that are produced by hydrocracking of sorbitol (Table 1):

TABLE 1

Polyols produced by Hydrocracking of Sorbitol (U.S. Pat. No. 4,935,102)

| Compound | Weight Percent | Boiling Point, ° C. |
|---|---|---|
| 2,3-Butanediol | 3.5 | 182 |
| Propylene glycol | 16.5 | 187 |
| 1,2-Butanediol | 2.0 | 192 |
| Ethylene glycol | 25.2 | 198 |
| 1,3-Butanediol | 2.7 | 206 |
| 2,3-Hexanediol | — | 206 |
| 1,2-Pentanediol | — | 210 |
| 1,4-Pentanediol | — | 220 |
| 1,4-Butanediol | 2.1 | 230 |
| 1,5-Pentanediol | 0.1 | 242 |
| Diethylene glycol | 2.2 | 245 |
| 1,6-Hexanediol | — | 250 |
| Triethylene glycol | 2.1 | 285. |

[1]Polyethyleneimine (MW = 600) with 20 ethoxylate groups per —NH.

[2]Amphiphilic alkoxylated grease cleaning polymer is a polyethyleneimine (MW = 600) with 24 ethoxylate groups per —NH.

[3]DTPA is diethylenetetraamine pentaacetic acid, a chelant, from Dow Chemical, Midland, Michigan, USA The detergent composition described herein may comprise from about 0.01% to about 0.1% of polyhydric alcohol. The detergent compositions described herein may comprise a polyhydric alcohol selected from the group consisting of 2,3-butanediol, 2,3-pentanediol, 2,4-pentanediol, 1,2-butanediol, 2,3-hexandiol, 1,5-pentanediol, and mixtures thereof. The detergent compositions described herein may comprise from about 0.01% to about 0.1% of 2,3-hexandiol.

Water

The detergent composition(s) may comprise from about 1% to about 80%, by weight of the composition, water.

When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

Ethanolamine

Ethanolamines, such as monoethanolamine, diethanolamine and triethanolamine, are known for use in detergent compositions. In particular, the use of monoethanolamine as a chlorine scavenger, to reduce the level of free chlorine in the wash solution and correspondingly reduce the fading associated with colored fabrics, is known. The compositions disclosed herein may be substantially free of ethanolamines, yet still provide effective chlorine scavenging and reduction in fading of colored fabrics. The compositions disclosed herein may be substantially free of monoethanolamine.

Additional Surfactants and Adjuncts

The detergent compositions disclosed herein may comprise additional surfactants and/or adjunct ingredients.

Additional Surfactants

In addition to the alkyl ether sulfate, the fatty alcohol ethoxylate, and the amine oxide, the detergent compositions disclosed herein may comprise an additional surfactant, e.g., a fourth surfactant, a fifth surfactant. The detergent composition may comprise from about 1% to about 75%, or from about 2% to about 35%, or from about 5% to about 10%, by weight of the composition, of an additional surfactant, e.g., a fourth surfactant, a fifth surfactant. The additional surfactant may be selected from the group consisting of anionic surfactants, nonionic surfactants, cationic surfactants, zwitterionic surfactants, amphoteric surfactants, ampholytic surfactants, and mixtures thereof.

Anionic Surfactants

The additional surfactant(s) may comprise one or more additional anionic surfactants. The additional anionic surfactant may be a renewable surfactant. Suitable additional anionic surfactants include petroleum-derived alkoxylated alkyl sulfates (e.g., petroleum-derived ethoxylated alkyl sulfate surfactants), non-alkoxylated alkyl sulfates, and sulfonic detersive surfactants, e.g., alkyl benzene sulfonates.

Examples of petroleum-derived ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts (included in the term "alkyl" is the alkyl portion of acyl groups). The alkyl group may contain from about 15 carbon atoms to about 30 carbon atoms. The ethoxylated alkyl sulfate surfactant may be a mixture of ethoxylated alkyl sulfates, where the mixture may have an average (arithmetic mean) carbon chain length within the range of about 12 to 30 carbon atoms, and an average (arithmetic mean) degree of ethoxylation of from about 1 mol to 4 mols of ethylene oxide. The ethoxylated alkyl sulfate surfactant may have a carbon chain length of from about 10 carbon atoms to about 18 carbon atoms, and a degree of ethoxylation of from about 1 to about 6 mols of ethylene oxide. The ethoxylated alkyl sulfate surfactant may contain a peaked ethoxylate distribution.

Non-alkoxylated alkyl sulfates may also be added to the disclosed detergent compositions and used as an anionic surfactant component. Examples of non-alkoxylated, e.g., non-ethoxylated, alkyl sulfate surfactants include those produced by the sulfation of higher $C_8$-$C_{20}$ synthetic alcohols. In some examples, primary alkyl sulfate surfactants have the general formula: $ROSO_3^-$ $M^+$, wherein R is a $C_8$-$C_{20}$ hydrocarbyl group, which may be straight or branched, and M is a water-solubilizing cation. In some examples, R is a $C_{10}$-$C_{15}$ alkyl, and M is an alkali metal.

Other useful anionic surfactants include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS. LAS may be derived from natural materials, including bioparaffin, natural alcohols and esters.

Suitable alkyl benzene sulfonate (LAS) may be obtained, by sulfonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulfonate that is obtained by DETAL catalyzed process, although other synthesis routes, such as HF, may also be suitable. In one aspect a magnesium salt of LAS is used.

Suitable anionic surfactants also include anionic branched surfactants selected from branched sulphate or branched sulphonate surfactants, e.g., branched alkyl sulphate, branched alkyl alkoxylated sulphate, and branched alkyl benzene sulphonates, comprising one or more random alkyl branches, e.g., $C_{1-4}$ alkyl groups, typically methyl and/or ethyl groups. The branched detersive surfactant may be a mid-chain branched detersive surfactant, e.g., a mid-chain branched anionic detersive surfactant, such as a mid-chain branched alkyl sulphate and/or a mid-chain branched alkyl benzene sulphonate. The branched anionic surfactant may comprise a branched modified alkylbenzene sulfonate (MLAS). The branched anionic surfactant may comprise a C12/13 alcohol-based surfactant comprising a methyl branch randomly distributed along the hydrophobe chain, e.g., Safol®, Marlipal® available from Sasol. Further suitable branched anionic detersive surfactants include those derived from anteiso and iso-alcohols.

Other anionic surfactants useful herein are the water-soluble salts of: paraffin sulfonates and secondary alkane sulfonates containing from about 8 to about 24 (and in some examples about 12 to 18) carbon atoms. Mixtures of the alkylbenzene sulfonates with the above-described paraffin sulfonates, secondary alkane sulfonates and alkyl glyceryl ether sulfonates are also useful.

Suitable additional, renewable, anionic surfactants include anionic surfactants derived from renewable isoprenoid-based polybranched detergent alcohols, renewable alkyl benzene sulfonate, renewable alcohol sulfate, and renewable paraffin sulfonate as described in US Patent Application No. 2015-0240187 A1, which is herein incorporated by reference, methyl ester sulfonates, alkyl glyceryl ether sulfonates, especially those ethers of $C_{8-18}$ alcohols (e.g., those derived from tallow and coconut oil), and alkyl ether carboxylates derived from (natural) fatty alcohols. Isoprenoid-based surfactants and isoprenoid derivatives (e.g., farnesene-based surfactants) are known; farnesene is available from Amyris.

The anionic surfactants may exist in an acid form, and the acid form may be neutralized to form a surfactant salt. Typical agents for neutralization include metal counterion bases, such as hydroxides, e.g., NaOH or KOH. Further suitable agents for neutralizing anionic surfactants in their acid forms include ammonia, amines, or alkanolamines. Non-limiting examples of alkanolamines include monoethanolamine, diethanolamine, triethanolamine, and other linear or branched alkanolamines known in the art. Amine neutralization may be done to a full or partial extent, e.g., part of the anionic surfactant mix may be neutralized with sodium or potassium and part of the anionic surfactant mix may be neutralized with amines or alkanolamines.

Nonionic Surfactant

The additional surfactant(s) may comprise one or more additional nonionic surfactants. The detergent composition may comprise from about 0.1% to about 40%, by weight of the composition, of one or more additional nonionic surfactants. The detergent composition may comprise from about 0.1% to about 15%, by weight of the composition, of one or more additional nonionic surfactants. The detergent composition may comprise from about 0.3% to about 10%, by weight of the composition, of one or more additional nonionic surfactants.

The additional nonionic surfactant may be a renewable surfactant. Suitable nonionic surfactants include $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA; $C_{14}$-$C_{22}$ mid-chain branched alkyl alkoxylates, BAEX, wherein x is from 1 to 30; and ether capped poly(oxyalkylated) alcohol surfactants.

Suitable renewable nonionic detersive surfactants include alkylpolysaccharides, such as alkylpolyglycosides, and methyl ester ethoxylates.

Cationic Surfactants

The additional surfactant(s) may comprise one or more one or more cationic surfactants.

The detergent composition may comprise from about 0.1% to about 10%, or about 0.1% to about 7%, or about 0.3% to about 5% by weight of the composition, of one or more cationic surfactants. The detergent compositions of the invention may be substantially free of cationic surfactants and surfactants that become cationic below a pH of 7 or below a pH of 6.

Non-limiting examples of cationic surfactants include: the quaternary ammonium surfactants, which can have up to 26 carbon atoms include: alkoxylate quaternary ammonium (AQA) surfactants; dimethyl hydroxyethyl quaternary ammonium; dimethyl hydroxyethyl lauryl ammonium chloride; polyamine cationic surfactants; cationic ester surfactants; and amino surfactants, e.g., amido propyldimethyl amine (APA).

Suitable cationic detersive surfactants also include alkyl pyridinium compounds, alkyl quaternary ammonium compounds, alkyl quaternary phosphonium compounds, alkyl ternary sulphonium compounds, and mixtures thereof.

Suitable cationic detersive surfactants are quaternary ammonium compounds having the general formula:

$$(R)(R1)(R2)(R3)N+X-$$

wherein, R is a linear or branched, substituted or unsubstituted C6-18 alkyl or alkenyl moiety, R1 and R2 are independently selected from methyl or ethyl moieties, R3 is a hydroxyl, hydroxymethyl or a hydroxyethyl moiety, X is an anion which provides charge neutrality, suitable anions include: halides, for example chloride; sulphate; and sulphonate. Suitable cationic detersive surfactants are mono-C6-18 alkyl mono-hydroxyethyl di-methyl quaternary ammonium chlorides. Highly suitable cationic detersive surfactants are mono-C8-10 alkyl mono-hydroxyethyl di-methyl quaternary ammonium chloride, mono-C10-12 alkyl mono-hydroxyethyl di-methyl quaternary ammonium chloride and mono-C10 alkyl mono-hydroxyethyl di-methyl quaternary ammonium chloride.

Zwitterionic Surfactants

Examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. Suitable examples of zwitterionic surfactants include betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$.

Amphoteric Surfactants

Examples of amphoteric surfactants include aliphatic derivatives of secondary or tertiary amines, or aliphatic derivatives of heterocyclic secondary and tertiary amines in which the aliphatic radical may be straight or branched-chain and where one of the aliphatic substituents contains at least about 8 carbon atoms, or from about 8 to about 18 carbon atoms, and at least one of the aliphatic substituents contains an anionic water-solubilizing group, e.g. carboxy, sulfonate, sulfate. Examples of compounds falling within this definition are sodium 3-(dodecylamino)propionate, sodium 3-(dodecylamino) propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis (2-hydroxyethyl)-2-sulfato-3-dodecoxypropylamine. Suitable amphoteric surfactants also include sarcosinates, glycinates, taurinates, and mixtures thereof.

Suitable branched anionic surfactants also include Guerbet-alcohol-based surfactants. Guerbet alcohols are branched, primary monofunctional alcohols that have two linear carbon chains with the branch point always at the second carbon position. Guerbet alcohols are chemically described as 2-alkyl-1-alkanols. Guerbet alcohols generally have from 12 carbon atoms to 36 carbon atoms. The Guerbet alcohols may be represented by the following formula: $(R1)(R2)CHCH_2OH$, where R1 is a linear alkyl group, R2 is a linear alkyl group, the sum of the carbon atoms in R1 and R2 is 10 to 34, and both R1 and R2 are present. Guerbet alcohols are commercially available from Sasol as Isofol® alcohols and from Cognis as Guerbetol.

Adjuncts

Suitable adjunct ingredients also include builders, structurants or thickeners, clay soil removal/anti-redeposition agents, polymeric soil release agents, polymeric dispersing agents, polymeric grease cleaning agents, enzymes, enzyme stabilizing systems, bleaching compounds, bleaching agents, bleach activators, bleach catalysts, dye transfer inhibiting agents, chelating agents, suds supressors, softeners, and perfumes.

Enzymes

The compositions described herein may comprise one or more enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, B-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the composition.

Enzyme Stabilizing System

The compositions may optionally comprise from about 0.001% to about 10%, or from about 0.005% to about 8%, or from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the detergent composition. In the case of aqueous detergent compositions comprising protease, a reversible protease inhibitor, such as a boron compound, including borate, 4-formyl phenylboronic acid, phenylboronic acid and derivatives thereof, or compounds such as calcium formate, sodium formate and 1,2-propane diol may be added to further improve stability.

Structurant/Thickeners

Suitable structurants/thickeners include di-benzylidene polyol acetal derivative. The fluid detergent composition may comprise from about 0.01% to about 1% by weight of a dibenzylidene polyol acetal derivative (DBPA), or from about 0.05% to about 0.8%, or from about 0.1% to about 0.6%, or even from about 0.3% to about 0.5%. The DBPA derivative may comprise a dibenzylidene sorbitol acetal derivative (DBS).

Suitable structurants/thickeners also include cellulose. The fluid detergent composition may comprise from about 0.005% to about 1% by weight of a cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. Other sources of cellulose include plant-based materials, such as beets, vegetables, citrus fiber.

Suitable structurants/thickeners also include coated bacterial cellulose. The bacterial cellulose may be at least partially coated with a polymeric thickener. The at least partially coated bacterial cellulose may comprise from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

Suitable structurants/thickeners also include cellulose fibers. The composition may comprise from about 0.01 to about 5% by weight of the composition of a cellulosic fiber. The cellulosic fiber may be extracted from vegetables, fruits or wood. Commercially available examples are Avicel® from FMC, Citri-Fi from Fiberstar or Betafib from Cosun.

Suitable structurants/thickeners also include non-polymeric crystalline hydroxyl-functional materials. The composition may comprise from about 0.01 to about 1% by weight of the composition of a non-polymeric crystalline, hydroxyl functional structurant. The non-polymeric crystalline, hydroxyl functional structurants generally may comprise a crystallizable glyceride which can be pre-emulsified to aid dispersion into the final fluid detergent composition. The crystallizable glycerides may include hydrogenated castor oil or "HCO" or derivatives thereof, provided that it is capable of crystallizing in the liquid detergent composition.

Suitable structurants/thickeners also include polymeric structuring agents. The compositions may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof.

Suitable structurants/thickeners also include di-amido-gellants. The external structuring system may comprise a di-amido gellant having a molecular weight from about 150 g/mol to about 1,500 g/mol, or even from about 500 g/mol to about 900 g/mol. Such di-amido gellants may comprise at least two nitrogen atoms, wherein at least two of said nitrogen atoms form amido functional substitution groups. The amido groups may be different or the same. Non-limiting examples of di-amido gellants are: N,N'-(2S,2'S)-1,1'-(dodecane-1,12-diylbis(azanediyl))bis(3-methyl-1-oxobutane-2,1-diyl)diisonicotinamide; dibenzyl (2S,2'S)-1,1'-(propane-1,3-diylbis(azanediyl))bis(3-methyl-1-oxobutane-2,1-diyl)dicarbamate; dibenzyl (2S,2'S)-1,1'-(dodecane-1,12-diylbis(azanediyl))bis(1-oxo-3-phenylpropane-2,1-diyl)dicarbamate.

Alternatively, the detergent compositions disclosed herein may be substantially free of structurants and/or thickeners.

Amines

Amines may be used in the compositions described herein for added removal of grease and particulates from soiled materials. The compositions described herein may comprise from about 0.1% to about 10%, in some examples, from about 0.1% to about 4%, and in other examples, from about 0.1% to about 2%, by weight of the detergent composition, of additional amines. Non-limiting examples of additional amines may include, but are not limited to, polyetheramines, polyamines, oligoamines, triamines, diamines, pentamines, tetraamines, or combinations thereof. Specific examples of suitable additional amines include tetraethylenepentamine, triethylenetetraamine, diethylenetriamine, or a mixture thereof.

Bleaching Agents

The detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition.

Bleach Catalysts

The detergent compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners, Fabric Hueing Agents,

Commercial fluorescent brighteners include derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents. The detergent compositions disclosed herein may be substantially free of brighteners (also known as fluorescent brighteners or optical brighteners).

Typically, the hueing agent provides a blue or violet shade to fabric. Hueing agents include the following known chemical classes of dye: acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof. Hueing agents include dyes, dye-clay conjugates, organic and inorganic pigments, small molecule dyes, and polymeric dyes. The detergent compositions disclosed herein may be substantially free of fabric hueing agent (sometimes referred to as shading, bluing or whitening agents).

Encapsulates

The compositions may comprise an encapsulate. The encapsulate may comprise a core, a shell having an inner and outer surface, where the shell encapsulates the core.

The encapsulate may comprise a core and a shell, where the core comprises a material selected from perfumes; brighteners; dyes; insect repellants; silicones; waxes; flavors; vitamins; fabric softening agents; skin care agents, e.g., paraffins; enzymes; anti-bacterial agents; bleaches; sensates; or mixtures thereof; and where the shell comprises a material selected from polyethylenes; polyamides; polyvinylalcohols, optionally containing other co-monomers; polystyrenes; polyisoprenes; polycarbonates; polyesters; polyacrylates; polyolefins; polysaccharides, e.g., alginate and/or chitosan; gelatin; shellac; epoxy resins; vinyl polymers; water insoluble inorganics; silicone; aminoplasts, or mixtures thereof. When the shell comprises an aminoplast, the aminoplast may comprise polyurea, polyurethane, and/or polyureaurethane. The polyurea may comprise polyoxymethyleneurea and/or melamine formaldehyde.

The encapsulate may comprise a core, and the core may comprise a perfume. The encapsulate may comprise a shell, and the shell may comprise melamine formaldehyde and/or cross linked melamine formaldehyde. The encapsulate may comprise a core comprising a perfume and a shell comprising melamine formaldehyde and/or cross linked melamine formaldehyde Suitable encapsulates may comprise a core material and a shell, where the shell at least partially surrounds the core material. The core of the encapsulate comprises a material selected from a perfume raw material and/or optionally another material, e.g., vegetable oil, esters of vegetable oils, esters, straight or branched chain hydrocarbons, partially hydrogenated terphenyls, dialkyl phthalates, alkyl biphenyls, alkylated naphthalene, petroleum spirits, aromatic solvents, silicone oils, or mixtures thereof.

The wall of the encapsulate may comprise a suitable resin, such as the reaction product of an aldehyde and an amine. Suitable aldehydes include formaldehyde. Suitable amines include melamine, urea, benzoguanamine, glycoluril, or mixtures thereof. Suitable melamines include methylol melamine, methylated methylol melamine, imino melamine and mixtures thereof. Suitable ureas include, dimethylol urea, methylated dimethylol urea, urea-resorcinol, or mixtures thereof.

Suitable formaldehyde scavengers may be employed with the encapsulates, for example, in a capsule slurry and/or added to a composition before, during, or after the encapsulates are added to such composition.

Suitable capsules can be purchased from Appleton Papers Inc. of Appleton, Wis. USA.

Perfumes

Perfumes and perfumery ingredients may be used in the detergent compositions described herein. Non-limiting examples of perfume and perfumery ingredients include, but are not limited to, aldehydes, ketones, esters, and the like. Other examples include various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes may be included at a concentration ranging from about 0.01% to about 2% by weight of the detergent composition.

Perfume Delivery Systems

The detergent compositions disclosed herein may comprise one or more types of perfume delivery systems. Non-limiting examples of the perfume delivery systems suitable for use herein include the following: non-sulfur-containing pro-perfume compound, perfume microcapsule (PMC), cyclodextrin, zeolite & inorganic carrier, starch encapsulated accord, amine-assisted perfume delivery system (AAD), polyacrylate capsule, and sulfur-containing pro-perfume compound.

Using a combination of multiple types of perfume delivery systems allows for the controlled release of a variety of different scent imparting substances, which may be an advantage over slowly releasing just one perfume as will happen if just one perfume oil or perfume delivery system is used. The composition(s) of the present disclosure may comprise a PMC. A PMC comprises a wall material and a core material of perfume raw material (PRM) that is encapsulated within the wall material. The PRM is released from the PMC after the wall material ruptures because of a mechanical stress (e.g., friction), i.e., the perfume release from the PMC is at different time points from the perfume oil and sulfur-containing pro-perfume compound.

The levels of these perfume delivery systems (not including the sulfur-containing pro-perfume compound) in the liquid detergent composition may depend on factors like the specific type of the composition. When present, the total levels of these perfume delivery systems (not including the sulfur-containing pro-perfume compound) in the liquid detergent composition are at least about 0.0001%, or from about 0.0001% to about 10%, or from about 0.001% to about 5%, or from about 0.1% to about 2%, by weight of the composition.

Sulfur-Containing Pro-Perfume Compound

The term "sulfur-containing pro-perfume compound" herein refers to a type of pro-perfume compound that contains sulfur. The term "pro-perfume compound" herein refers to compounds resulting from the reaction of PRMs with other chemicals, which have a covalent bond between one or more PRMs and these other chemicals. The PRM is converted into a new material called a pro-perfume compound, which then may release the original PRM (i.e., pre-converted) upon exposure to a trigger such as water or light or atmospheric oxygen.

The sulfur-containing pro-perfume compound may comprise a compound of formula (I):

Y—S-G-Q (I)

wherein:

(i) Y is a radical selected from the group consisting of (Y-1) to (Y-7) shown herein below, including isomeric forms (Y-1)

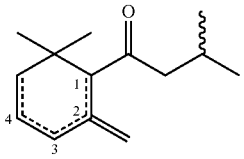

(Y-2)

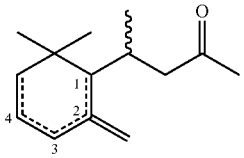

(Y-3)

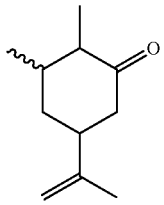

(Y-4)

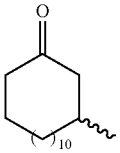

-continued (Y-5)

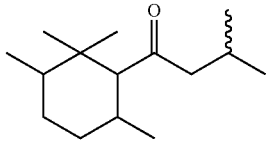

(Y-6)

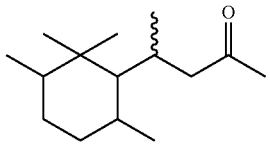

(Y-7)

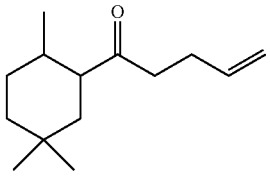

wherein the wavy lines represent the location of the sulfur bond, and the dotted lines represent a single or double bond;

(ii) G is selected from a divalent or trivalent radical derived from a linear or branched alkyl or alkenyl radical having from 2 to 15 carbon atoms; and (iii) Q is selected from a hydrogen, a —S—Y group, or a —$NR^2$—Y group, wherein Y is independently selected as defined above, and $R^2$ is selected from a hydrogen or a $C_1$-$C_3$ alkyl group.

G may be a divalent or trivalent radical. G may be a divalent radical derived from a linear or branched alkyl or alkenyl radical having from 2 to 15 carbon atoms, substituted with one or more groups selected from the group consisting of —OR, —$NR^{12}$, —$COOR^1$, $R^1$ groups, and a combination thereof, wherein $R^1$ is selected from a hydrogen or a $C_1$ to $C_6$ alkyl or alkenyl group. G may be a divalent radical derived from a linear or branched alkyl or alkenyl radical having from 2 to 15 carbon atoms, substituted with at least one —$COOR^1$ group, preferably substituted with a —$COOR^1$ group, wherein $R^1$ is selected from a hydrogen or a $C_1$ to $C_6$ alkyl or alkenyl group. G may be a divalent radical derived from a linear alkyl radical having a —$CH_2CH(COOR^1)$ group, wherein $R^1$ is a hydrogen or a methyl or ethyl group. G may be a divalent radical derived from a linear alkyl radical having from 8 to 15 carbon atoms which is either substituted or un-substituted.

The sulfur-containing pro-perfume compound may be a compound of formula (I) wherein Y is selected from Y-1, Y-2 or Y-3 groups as defined above, and G and Q are defined in any one of the above-described ways.

The sulfur-containing pro-perfume compound may be selected from the group consisting of methyl or ethyl 2-(4-oxo-4-(2,6,6-trimethylcyclohex-3-en-1-yl)butan-2-ylamino)-3-(4-oxo-4-(2,6,6-trimethylcyclohex-3-en-1-yl)butan-2-ylthio)propanate, methyl or ethyl 2-(4-oxo-4-(2,6,6-trimethylcyclohex-2-en-1-yl)butan-2-ylamino)-3-(4-oxo-4-(2,6,6-trimethycyclohex-2-en-1-yl)butan-2-ylthio)propanate, methyl or ethyl 2-(2-oxo-4-(2,6,6-trimethylcyclohex-1-en-1-yl)butan-4-ylamino)-3-(2-oxo-4-(2,6,6-trimethylcyclohex-1-en-1-yl)butan-4-ylthio)propanate, methyl or ethyl 2-(2-oxo-4-(2,6,6-trimethylcyclohex-2-en-1-yl)butan-4-ylamino)-3-(2-oxo-4-(2,6,6-trimethylcyclohex-2-en-1-yl)butan-4-ylthio)propanate, 3-(dodecylthio)-1-(2,6,6-trimethylcyclohex-3-en-1-yl)-1-butanone, 3-(dodecylthio)-1-(2,6,6-trimethylcyclohex-2-en-1-yl)-1-butanone, 4-(dodecylthio)-4-(2,6,6-trimethylcyclohex-2-en-1-yl)-2-butanone, 4-(dodecylthio)-4-(2,6,6-trimethylcyclohex-1-en-1-yl)-2-butanone, 2-dodecylsulfanyl-5-methyl-heptan-4-one, 2-cyclohexyl-1-dodecylsulfanyl-hept-6-en-3-one, 3-(dodecylthio)-5-isopropenyl-2-methylcyclohexanone, and a combination thereof.

The sulfur-containing pro-perfume compound may be selected from the group consisting of 3-(dodecylthio)-1-(2,6,6-trimethylcyclohex-3-en-1-yl)-1-butanone, 4-(dodecylthio)-4-(2,6,6-trimethylcyclohex-2-enl-yl)-2-butanone, 4-(dodecylthio)-4-(2,6,6-trimethylcyclohex-1-en-1-yl)-2-butanone and 3-(dodecylthio)-5-isopropenyl-2-methylcyclohexanone, and a combination thereof.

The sulfur-containing pro-perfume compound may be 3-(dodecylthio)-1-(2,6,6-trimethylcyclohex-3-en-1-yl)-1-butanone, such as Haloscent® D available from Firmenich located in Geneva, Switzerland.

The sulfur-containing pro-perfume compound may be present at any suitable level in the detergent composition. The sulfur-containing pro-perfume compound may be present at least about 0.0001%, or from about 0.0001% to about 5%, or from about 0.001% to about 4%, or from about 0.01% to about 3%, or from about 0.1% to about 2%, or from about 0.3% to about 1%, by weight of the composition.

Dye Transfer Inhibiting Agents

Fabric detergent compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, and in other examples, from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof. Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Suds Suppressors

Compounds for reducing or suppressing the formation of suds can be incorporated into the detergent compositions described herein. Suds suppression can be of particular importance in the so-called "high concentration cleaning process" and in front-loading style washing machines. The detergent compositions herein may comprise from 0.1% to about 10%, by weight of the composition, of suds suppressor.

Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic $C_{18}$-$C_{40}$ ketones (e.g., stearone), N-alkylated amino triazines, waxy hydrocarbons preferably having a melting point below about 100° C., silicone suds suppressors, and secondary alcohols.

Additional suitable antifoams are those derived from phenylpropylmethyl substituted polysiloxanes.

The detergent composition may comprise a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor.

The detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

Suds Boosters

If high sudsing is desired, suds boosters such as the $C_{10}$-$C_{16}$ alkanolamides may be incorporated into the detergent compositions at a concentration ranging from about 1% to about 10% by weight of the detergent composition. Some examples include the $C_{10}$-$C_{14}$ monoethanol and diethanol amides. If desired, water-soluble magnesium and/or calcium salts such as $MgCl_2$, $MgSO_4$, $CaCl_2$, $CaSO_4$, and the like, may be added at levels of about 0.1% to about 2% by weight of the detergent composition, to provide additional suds and to enhance grease removal performance.

Conditioning Agents

The composition of the present invention may include a high melting point fatty compound. The high melting point fatty compound useful herein has a melting point of 25° C. or higher, and is selected from the group consisting of fatty alcohols, fatty acids, fatty alcohol derivatives, fatty acid derivatives, and mixtures thereof. Such compounds of low melting point are not intended to be included in this section. The high melting point fatty compound is included in the composition at a level of from about 0.1% to about 40%, preferably from about 1% to about 30%, more preferably from about 1.5% to about 16% by weight of the composition, from about 1.5% to about 8%.

The composition of the present invention may include a nonionic polymer as a conditioning agent.

Suitable conditioning agents for use in the composition include those conditioning agents characterized generally as silicones (e.g., silicone oils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. The concentration of the silicone conditioning agent typically ranges from about 0.01% to about 10%.

The compositions of the present invention may also comprise from about 0.05% to about 3% of at least one organic conditioning oil as the conditioning agent, either alone or in combination with other conditioning agents, such as the silicones (described herein). Suitable conditioning oils include hydrocarbon oils, polyolefins, and fatty esters.

Fabric Enhancement Polymers

Suitable fabric enhancement polymers are typically cationically charged and/or have a high molecular weight. Suitable concentrations of this component are in the range from 0.01% to 50%, preferably from 0.1% to 15%, more preferably from 0.2% to 5.0%, and most preferably from 0.5% to 3.0% by weight of the composition. The fabric enhancement polymers may be a homopolymer or be formed from two or more types of monomers. The monomer weight of the polymer will generally be between 5,000 and 10,000,000, typically at least 10,000 and preferably in the range 100,000 to 2,000,000. Preferred fabric enhancement polymers will have cationic charge densities of at least 0.2 meq/gm, preferably at least 0.25 meq/gm, more preferably at least 0.3 meq/gm, but also preferably less than 5 meq/gm, more preferably less than 3 meq/gm, and most preferably less than 2 meq/gm at the pH of intended use of the composition, which pH will generally range from pH 3 to pH 9, preferably between pH 4 and pH 8. The fabric enhancement polymers may be of natural or synthetic origin.

Pearlescent Agent

The laundry detergent compositions of the invention may comprise a pearlescent agent. Non-limiting examples of pearlescent agents include: mica; titanium dioxide coated mica; bismuth oxychloride; fish scales; mono and diesters of alkylene glycol. The pearlescent agent may be ethyleneglycoldistearate (EGDS).

Hygiene and Malodour

The compositions of the present invention may also comprise one or more of zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Buffer System

The detergent compositions described herein may be formulated such that, during use in aqueous cleaning operations, the wash water will have a pH of between about 7.0 and about 12, and in some examples, between about 7.0 and about 11. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

The detergent compositions herein may comprise dynamic in-wash pH profiles. Such detergent compositions may use wax-covered citric acid particles in conjunction with other pH control agents such that (i) about 3 minutes after contact with water, the pH of the wash liquor is greater than 10; (ii) about 10 minutes after contact with water, the pH of the wash liquor is less than 9.5; (iii) about 20 minutes after contact with water, the pH of the wash liquor is less than 9.0; and (iv) optionally, wherein, the equilibrium pH of the wash liquor is in the range of from about 7.0 to about 8.5.

Water-Soluble Film

The compositions of the present disclosure may be encapsulated within a water-soluble film, for example, a film comprising polyvinyl alcohol (PVOH).

Other Adjunct Ingredients

A wide variety of other ingredients may be used in the detergent compositions herein, including other active ingredients, carriers, hydrotropes, processing aids, solvents for liquid formulations, and solid or other liquid fillers, erythrosine, colliodal silica, waxes, probiotics, surfactin, aminocellulosic polymers, Zinc Ricinoleate, perfume microcapsules, rhamnolipids, sophorolipids, glycopeptides, methyl ester sulfonates, methyl ester ethoxylates, sulfonated estolides, cleavable surfactants, biopolymers, silicones, modified silicones, aminosilicones, deposition aids, locust bean gum, cationic hydroxyethylcellulose polymers, cationic guars, hydrotropes (especially cumenesulfonate salts, toluenesulfonate salts, xylenesulfonate salts, and naphalene salts), antioxidants, BHT, PVA particle-encapsulated dyes or perfumes, pearlescent agents, effervescent agents, color change systems, silicone polyurethanes, opacifiers, tablet disintegrants, biomass fillers, fast-dry silicones, glycol distearate, hydroxyethylcellulose polymers, hydrophobically modified cellulose polymers or hydroxyethylcellulose polymers, starch perfume encapsulates, emulsified oils, bisphenol antioxidants, microfibrous cellulose structurants, properfumes, styrene/acrylate polymers, triazines, soaps, superoxide dismutase, benzophenone protease inhibitors, functionalized TiO2, dibutyl phosphate, silica perfume capsules, and other adjunct ingredients, silicate salts (e.g., sodium silicate, potassium silicate), choline oxidase, pectate lyase, mica, titanium dioxide coated mica, bismuth oxychloride, and other actives.

The compositions described herein may also contain vitamins and amino acids such as: water soluble vitamins and their derivatives, water soluble amino acids and their salts and/or derivatives, water insoluble amino acids viscosity modifiers, nonvolatile solvents or diluents (water soluble and insoluble), pearlescent aids, foam boosters, additional surfactants or nonionic cosurfactants, pediculocides, pH adjusting agents, perfumes, preservatives, chelants, proteins, skin active agents, sunscreens, UV absorbers, vitamins, niacinamide, caffeine, and minoxidil.

The compositions of the present disclosure may also contain pigment materials such as nitroso, monoazo, disazo, carotenoid, triphenyl methane, triaryl methane, xanthene, quinoline, oxazine, azine, anthraquinone, indigoid, thioindigoid, quinacridone, phthalocianine, botanical, and natural colors, including water soluble components such as those having C.I. Names. The detergent compositions of the present invention may also contain antimicrobial agents.

Packaging for the Compositions

The detergent compositions described herein can be packaged in any suitable container including those constructed from paper, cardboard, plastic materials, and any suitable laminates. The detergent compositions described herein may also be packaged as a multi-compartment detergent composition.

The present disclosure also relates to a transparent or translucent liquid laundry detergent composition in a transparent bottle, where the composition comprises from about 1% to about 20% by weight of alkyl ether sulfate of the formula $R^1—(OCH_2CH_2)_x—O—SO_3M$, where $R^1$ is a non-petroleum derived, linear or branched fatty alcohol consisting of even numbered carbon chain lengths of from about $C_8$ to about $C_{20}$, and where x is from about 0.5 to about 8, and where M is an alkali metal or ammonium cation; from about 1% to about 15% by weight of fatty alcohol ethoxylate of formula $R^2—(OCH_2CH_2)_y—OH$, where $R^2$ is a non-petroleum derived, linear or branched fatty alcohol consisting of even numbered carbon chain lengths of from about $C_{10}$ to about $C_{18}$, and where y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the transparent or translucent composition has about 50% transmittance or greater of light using 1 cm cuvette at wavelength of 410-800 nanometers; and where the transparent bottle has light transmittance of greater than 25% at wavelength of about 410-800 nm.

Clear bottle materials that may be used include, but are not limited to: polypropylene (PP), polyethylene (PE), polycarbonate (PC), polyamides (PA) and/or polyethylene terephthalate (PETE), polyvinylchloride (PVC); and polystyrene (PS).

The transparent bottle or container may have a transmittance of more than about 25%, or more than about 30%, or more than about 40%, or more than about 50% in the visible part of the spectrum (approx. 410-800 nm). Alternatively, absorbency of the bottle may be measured as less than about 0.6 or by having transmittance greater than about 25%, where % transmittance equals:

$$\frac{1}{10^{absorbancy}} \times 100\%$$

For purposes of the disclosure, as long as one wavelength in the visible light range has greater than about 25% transmittance, it is considered to be transparent/translucent.

The container or bottle may be of any form or size suitable for storing and packaging liquids for household use. For example, the container may have any size but usually the container will have a maximal capacity of about 0.05 to about 15 L, or about 0.1 to about 5 L, or from about 0.2 to about 2.5 L. The container may be suitable for easy handling. For example, the container may have handle or a part with such dimensions to allow easy lifting or carrying the container with one hand. The container may have a means suitable for pouring a liquid detergent composition and means for reclosing the container. The pouring means may be of any size or form. The closing means may be of any form or size (e.g., to be screwed or clicked on the container to close the container). The closing means may be cap, which can be detached from the container. Alternatively, the cap may be attached to the container, whether the container is open or closed. The closing means may also be incorporated in the container.

Methods of Use

The present disclosure includes methods for cleaning soiled material. As will be appreciated by one skilled in the art, the cleaning compositions of the present invention are suited for use in laundry pretreatment applications, laundry cleaning applications, and home care applications.

Such methods include, but are not limited to, the steps of contacting cleaning compositions in neat form or diluted in wash liquor, with at least a portion of a soiled material and then optionally rinsing the soiled material. The soiled material may be subjected to a washing step prior to the optional rinsing step.

For use in laundry pretreatment applications, the method may include contacting the cleaning compositions described herein with soiled fabric. Following pretreatment, the soiled fabric may be laundered in a washing machine or otherwise rinsed.

Machine laundry methods may comprise treating soiled laundry with an aqueous wash solution in a washing machine having dissolved or dispensed therein an effective amount of a machine laundry cleaning composition in accord with the invention. An "effective amount" of the cleaning composition means from about 20 g to about 300 g of product dissolved or dispersed in a wash solution of volume from about 5 L to about 65 L. The water temperatures may range from about 5° C. to about 100° C. The water to soiled material (e.g., fabric) ratio may be from about 1:1 to about 20:1. In the context of a fabric laundry composition, usage levels may also vary depending not only on the type and severity of the soils and stains, but also on the wash water temperature, the volume of wash water, and the type of washing machine (e.g., top-loading, front-loading, top-loading, vertical-axis Japanese-type automatic washing machine).

The cleaning compositions herein may be used for laundering of fabrics at reduced wash temperatures. These methods of laundering fabric comprise the steps of delivering a laundry cleaning composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the laundry cleaning composition with water.

Hand washing/soak methods, and combined handwashing with semi-automatic washing machines, are also included.

The present disclosure also relates to a method of laundering colored fabric which comprises the steps of: providing a detergent composition where the composition comprises from about 1% to about 20% by weight of alkyl ether sulfate of the formula $R^1$—$(OCH_2CH_2)_x$—O—$SO_3M$, where $R^1$ is a non-petroleum derived, linear or branched fatty alcohol consisting of even numbered carbon chain lengths of from about $C_8$ to about $C_{20}$, and where x is from about 0.5 to about 8, and where M is an alkali metal or ammonium cation; from about 1% to about 15% by weight of fatty alcohol ethoxylate of formula $R^2$—$(OCH_2CH_2)_y$—OH, where $R^2$ is a non-petroleum derived, linear or branched fatty alcohol consisting of even numbered carbon chain lengths of from about $C_{10}$ to about $C_{18}$, and where y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the composition is substantially free of brightener and monoethanolamine; diluting a dose of the detergent composition in water by a factor of greater than 500 to obtain a wash liquor which comprises 0.8 to 0.035 g/L of surfactant; washing the colored fabric with the wash liquor so formed, where the chlorine scavenging efficiency is at least about 90%, or at least about 80%, or at least about 70%, or at least about 60%, or at least about 50%, or at least about 40%, at an initial free chlorine concentration of 2.4 ppm.

Specific contemplated aspects of the disclosure are herein described in the following numbered paragraphs.

1. A laundry detergent composition comprising: from about 1% to about 20% by weight of alkyl ether sulfate of the formula $R^1$—$(OCH_2CH_2)_x$—O—$SO_3M$, wherein $R^1$ is a non-petroleum derived, linear or branched fatty alcohol consisting of even numbered carbon chain lengths of from about $C_8$ to about $C_{20}$, and wherein x is from about 0.5 to about 8, and where M is an alkali metal or ammonium cation; from about 1% to about 15% by weight of fatty alcohol ethoxylate of formula $R^2$—$(OCH_2CH_2)_y$—OH, wherein $R^2$ is a non-petroleum derived, linear or branched fatty alcohol consisting of even numbered carbon chain lengths of from about $C_{10}$ to about $C_{18}$, and wherein y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; wherein the composition is substantially free of dye and brightener.

2. A transparent or translucent liquid laundry detergent composition in a transparent bottle, wherein the composition comprises from about 1% to about 20% by weight of alkyl ether sulfate of the formula $R^1$—$(OCH_2CH_2)$—O—$SO_3M$, wherein $R^1$ is a non-petroleum derived, linear or branched fatty alcohol consisting of even numbered carbon chain lengths of from about $C_8$ to about $C_{20}$, and wherein x is from about 0.5 to about 8, and wherein M is an alkali metal or ammonium cation; from about 1% to about 15% by weight of fatty alcohol ethoxylate of formula $R^2$—$(OCH_2CH_2)_y$—OH, wherein $R^2$ is a non-petroleum derived, linear or branched fatty alcohol consisting of even numbered carbon chain lengths of from about $C_{10}$ to about $C_{18}$, and wherein y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the transparent or translucent composition has about 50% transmittance or greater of light using 1 cm cuvette at wavelength of 410-800 nanometers; and where the transparent bottle has light transmittance of greater than 25% at wavelength of about 410-800 nm.

3. A method of laundering colored fabric which comprises the steps of: providing a laundry detergent composition where the composition comprises from about 1% to about 20% by weight of alkyl ether sulfate of the formula $R^1$—$(OCH_2CH_2)_x$—O—$SO_3M$, wherein $R^1$ is a non-petroleum derived, linear or branched fatty alcohol consisting of even numbered carbon chain lengths of from about $C_8$ to about $C_{20}$, and wherein x is from about 0.5 to about 8, and wherein M is an alkali metal or ammonium cation; from about 1% to about 15% by weight of fatty alcohol ethoxylate of formula $R^2$—$(OCH_2CH_2)_y$—OH, wherein $R^2$ is a non-petroleum derived, linear or branched fatty alcohol consisting of even numbered carbon chain lengths of from about $C_{10}$ to about $C_{18}$, and wherein y is from about 0.5 to about 15; from about 0.1% to about 5% by weight of amine oxide; from about 0.1% to about 5% of a cleaning polymer; from about 1% to about 15% by weight of a solvent comprising 1,2-propanediol; and water; where the composition is substantially free of brightener and monoethanolamine; diluting a dose of the detergent composition in water by a factor of greater than 500 to obtain a wash liquor which comprises 0.8 to 0.035 g/L of surfactant; washing the colored fabric with the wash liquor so formed, where the chlorine scavenging efficiency is at least about 90% at an initial free chlorine concentration of 2.4 ppm.

4. The laundry detergent composition of any of the preceding paragraphs wherein the laundry detergent composition comprises a polyhydric alcohol selected from the group consisting of 2,3-butanediol, 2,3-pentanediol, 2,4-pentanediol, 1,2-butanediol, 2,3-hexandiol, 1,5-pentanediol, and mixtures thereof.

5. The laundry detergent composition of any of the preceding paragraphs wherein the composition comprises from about 0.01% to about 0.1% of a polyhydric alcohol.

6. The laundry detergent composition of any of the preceding paragraphs wherein the composition comprises from about 0.01% to about 0.1% of 2,3-hexandiol.

7. The laundry detergent composition of any of the preceding paragraphs wherein the composition is substantially free of linear or branched alkyl benzene sulfonates.

8. The laundry detergent composition of any of the preceding paragraphs wherein the composition is substantially free of monoethanolamine.

9. The laundry detergent composition of any of the preceding paragraphs wherein the composition comprises an enzyme selected from the group consisting of lipase, cellulase, protease, amylase, and mixtures thereof.

10. The laundry detergent composition of any of the preceding paragraphs wherein the cleaning polymer is selected from the group consisting of modified or unmodified cellulosic polymer, polycarboxylates, polyamines, oligoamines, triamines, diamines, pentamines, tetraamines, alkoxylated polyalkylenimines, soil release polymers, and mixtures thereof.

11. The laundry detergent composition of any of the preceding paragraphs wherein the cleaning polymer comprises one or more alkoxylated polyalkylenimines.

12. The laundry detergent composition of any of the preceding paragraphs wherein the composition comprises an adjunct.

13. The laundry detergent composition of any of the preceding paragraphs wherein the composition comprises an adjunct selected from the group consisting of a structurant, a builder, a fabric softening agent, a polymer or an oligomer, an enzyme, an enzyme stabilizer, a bleach system, a brightener, a hueing agent, a chelating agent, a suds suppressor, a conditioning agent, a humectant, a perfume, a perfume microcapsule, a filler or carrier, an alkalinity system, a pH control system, a buffer, an alkanolamine, a solvent, and mixtures thereof.

14. The laundry detergent composition of any of the preceding paragraphs wherein the composition comprises an adjunct selected from one or perfume delivery systems.

15. The laundry detergent composition of any of the preceding paragraphs wherein the composition comprises a perfume delivery system selected from the group consisting of perfume microcapsule (PMC), amine-assisted perfume delivery system (AAD), polyacrylate capsule, and sulfur-containing pro-perfume compound, and mixtures thereof.

16. The laundry detergent composition of any of the preceding paragraphs wherein the composition comprises an adjunct selected from thiodamascone.

17. The laundry detergent composition of any of the preceding paragraphs wherein the composition is substantially free of dye and brightener.

18. The laundry detergent composition of any of the preceding paragraphs wherein the composition is substantially free of monoethanolamine.

19. The laundry detergent composition of any of the preceding paragraphs wherein the composition is substantially free of linear or branched alkyl benzene sulfonates.

EXAMPLES

Example 1

Liquid Laundry Detergent Compositions

TABLE 1

| Raw Material | A | B | C | D | E |
|---|---|---|---|---|---|
| C11.8 HLAS | — | 2.00 | — | — | — |
| NI C24 EO9 | 7.00 | 4.00 | — | — | 9.00 |
| NI C16 EO7 | — | 1.00 | 5.00 | — | — |
| C12/14 AMINE OXIDE | 3.00 | 2.50 | 1.00 | 2.00 | 4.00 |

TABLE 1-continued

| Raw Material | A | B | C | D | E |
|---|---|---|---|---|---|
| AES $C_{12-15}$ alkyl ethoxy (1.8) sulfate | — | — | 3.00 | — | — |
| sodium laureth (1) sulfate | 10.00 | 17.00 | 9.00 | 12.00 | 22.00 |
| CITRIC ACID | — | 2.00 | 1.00 | 3.00 | 3.00 |
| C1218 FATTY ACID | 2.00 | 1.50 | 3.00 | 2.00 | — |
| DTPA[3] | 0.30 | 0.10 | 0.70 | — | 0.60 |
| Mannanase | — | — | 0.04 | 0.01 | 0.02 |
| Protease | 0.12 | 0.09 | 0.10 | 0.03 | — |
| Amylase | 0.02 | 0.01 | — | — | 0.03 |
| Sodium Chloride | — | — | — | — | 0.01 |
| Sodium Tetraborate | 1.10 | 1.00 | 1.00 | 0.90 | 1.00 |
| CALCIUM FORMATE | 0.20 | 0.17 | 0.10 | 0.05 | 0.12 |
| Na Formate | 0.06 | 0.11 | 0.18 | 0.09 | — |
| Ethoxylated Polyethyleneimine[1] | — | 1.00 | 0.50 | 1.25 | 3.00 |
| Amphiphilic alkoxylated grease cleaning polymer[2] | 1.50 | 1.00 | 3.50 | 2.75 | — |
| disodium diaminostilbene disulfonate | — | — | 0.30 | — | — |
| Sorbitol | 0.10 | 0.20 | — | 0.05 | 0.13 |
| Ethanol | 2.00 | 4.00 | 1.50 | 0.80 | — |
| Propylene Glycol | 10.00 | 5.00 | 12.00 | 7.00 | 15.00 |
| Sodium Cumene Sulfonate | — | — | — | 4.00 | — |
| diethylene glycol | — | 2.00 | — | 4.00 | — |
| Sodium Hydroxide | 1.00 | 3.00 | 2.40 | 1.70 | 2.00 |
| Perfume | 0.45 | 0.65 | 0.20 | 1.00 | 0.80 |
| Water & Minors | | | To Balance | | |

Example 2

Comparative Stain Removal in Liquid Laundry Detergent Compositions

TABLE 2

| Composition | Ingredients (in order of decreasing concentration) |
|---|---|
| Seventh Generation ® Lavender & Blue *Eucalyptus* Natural Laundry Detergent | Water, laureth-6, sodium lauryl sulfate, sodium citrate, glycerin, boric acid, oleic acid, sodium chloride, sodium hydroxide, calcium chloride, citric acid, protease, amylase and mannanase, benzisothiazolinone and methylisothiazolinone. *Eucalyptus dives*, *lavandula angustifolia* oil, *lavandula hybrida* oil, *pinus sylvestris*. |
| Kirkland Signature ™ Concentrated Environmentally Responsible Laundry Detergent | Water, C12-16 Pareth-7, C12-15 Pareth-9, Citric Acid, Sodium Hydroxide, Sodium Dodecylbenzenesulfonate, Methyl Ester Sulfonate, Protease, Sodium Cocoate, Acrylic Polymer, Trisodium Dicarboxymethyl Alaninate, Fragrance, Benzisothiazolinone, methylisothiazolinone, methylchloroisothiazolinone, Calcium Chloride. |
| Tide ® Original Scent | Water, alcohol ethoxy sulfate, linear alkylbenzene sulfonate, propylene glycol, citric acid, sodium hydroxide, borax, ethanolamine, ethanol, alcohol sulfate, polyethyleneimine alkoxylates, sodium fatty acids, protease, diethylene glycol, alkyldimethylamine oxide, fragrance, amylase, DTPA, disodium diaminostilbene disulfonate, sodium cumene sulfonate, hydrogenated castor oil, sodium formate, calcium formate, silicone suds suppressor, mannanase, Liquitint ™ Blue, dimethicone. |
| F (composition according to the present disclosure) | Water, sodium laureth (1) sulfate, biobased propylene glycol, nonionic surfactant C24-9, citric acid, amine oxide, sodium hydroxide, fatty acid, ethanol, polyethyleneimine alkoxylates, borax, DTPA, fragrance, calcium formate, sodium formate, sorbitol, protease, amylase, silicone process aid, preservative. |

Technical stain swatches of CW120 cotton containing burnt butter, cooked beef, dyed bacon, animal blood, grass, barbeque sauce, gravy, chocolate sauce, chocolate soy milk, rice starch, blueberries, grape juice, Lipton tea, Nescafe coffee, red wine, black Todd clay, US clay, liquid makeup, mustard, and spaghetti sauce, are purchased from Empirical Manufacturing Co., Inc (Cincinnati, Ohio). The swatches are washed in a Whirlpool® front loader washing machine, using 6 grains per gallon water hardness and washed at 100 degrees Fahrenheit. The total amount of liquid detergent used in the test was 49 grams.

Standard colorimetric measurement is used to obtain L*, a* and b* values for each stain before and after the washing. From L*, a* and b* values, the stain level is calculated.

Stain removal from the swatches was measured as follows:

$$\text{Stain Removal Index } (SRI) = \frac{\Delta E_{initial} - \Delta E_{washed}}{\Delta E_{initial}} \times 100$$

$\Delta E_{initial}$ = Stain level before washing $\Delta E_{washed}$ = Stain level after washing Eight replicates of each stain type were prepared. The SRI values shown below are the averaged SRI values for each stain type. The stain level of the fabric before the washing ($\Delta E_{initial}$) is high; in the washing process, stains are removed and the stain level after washing is reduced ($\Delta E_{washed}$). The better a stain has been removed, the lesser the value for $\Delta E_{washed}$ and the greater the difference between $\Delta E_{initial}$ and $\Delta E_{washed}$ ($\Delta E_{initial} - \Delta E_{washed}$). Therefore the value of the stain removal index increases with better washing performance.

TABLE 3

| | Tide ® Original Scent | Kirkland Signature ™ | Seventh Generation ® | F | |
|---|---|---|---|---|---|
| Overall Average | 52.76 | 44.64 | 43.60 | 52.19 | HSD |
| Stain Removal | | | | | |
| Burnt Butter | 58.37 | 31.37 | 30.02 | 46.25 | 2.83 |
| Cooked Beef | 42.86 | 27.65 | 25.80 | 35.87 | 3.21 |
| Dyed Bacon | 50.14 | 46.30 | 47.37 | 46.09 | 2.78 |
| Animal Blood | 84.57 | 87.58 | 86.53 | 86.14 | 1.41 |
| Grass | 69.63 | 49.90 | 48.73 | 64.01 | 5.75 |
| BBQ Sauce | 87.52 | 80.32 | 81.12 | 88.23 | 1.68 |
| Gravy | 84.88 | 64.24 | 65.07 | 83.88 | 2.45 |
| Chocolate Sauce | 61.40 | 60.29 | 57.24 | 62.09 | 2.17 |
| Chocolate Soy Milk | 28.71 | 20.92 | 12.64 | 28.19 | 4.09 |
| Rice Starch | 63.41 | 25.93 | 33.31 | 56.81 | 2.25 |
| Blueberries | 61.98 | 58.58 | 56.20 | 65.04 | 1.86 |
| Grape Juice | 39.06 | 35.85 | 34.94 | 44.13 | 4.71 |
| Lipton Tea | 20.17 | 20.38 | 15.56 | 21.27 | 3.43 |
| Nescafe Coffee | 46.06 | 44.99 | 45.60 | 47.94 | 3.05 |
| Red Wine | 35.10 | 34.25 | 30.80 | 37.55 | 4.06 |
| Black Todd Clay | 60.28 | 52.64 | 52.88 | 57.56 | 3.35 |
| US Clay | 51.80 | 47.41 | 46.22 | 50.87 | 1.84 |
| Liquid Make-Up | 43.05 | 39.72 | 37.43 | 40.97 | 3.42 |
| Mustard | 29.09 | 32.60 | 31.44 | 32.90 | 2.21 |
| Spaghetti Sauce | 69.85 | 44.56 | 52.26 | 70.23 | 4.01 |

These results illustrate the surprising stain removal benefits of the composition(s) of the present disclosure (F), as compared to several known, eco-friendly laundry detergents (Kirkland Signature™ and Seventh Generation®) and a known, traditional laundry detergent (Tide® Original Scent).

Example 3

Whiteness Maintenance

The after wash versus before wash difference in CIE Whiteness Index values (D65 illumination) is measured for the added test fabrics. A larger, more negative ΔWI CIE value indicates poorer soil antiredeposition performance of the formulation. Data is analyzed via an analysis of variance technique.

Technical stain swatches of new, white 50% cotton/50% polyester knit are washed in a Whirlpool® front loader washing machine, using 6 grains per gallon water hardness and washed at 100 degrees Fahrenheit with 8.5 pounds of ballast comprised of cotton and polycotton knit swatches and swatches containing soil (e.g., clay soils, artificial body soils). The total amount of liquid detergent used in the test was 49 grams.

More negative whiteness index values indicate graying of the fabric (where a value of 0 corresponds to a new, white fabric).

Whiteness Index ("WI") is a qualifying assessment of color that is calculated by a formula which includes three components of color measurement—hue, saturation, and lightness—which is then indexed to a standard white value. CIE Whiteness is expressed by the formula: WI=Y−(800*x)−(1700*y)+813.7, where Y, x and y are colorimetric values. Further information is available in the publication of Rolf Griesser, Ciba-Geigy Ltd, "Whiteness and Tint", June 1993.

TABLE 4

| | Tide ® | F | Seventh Generation ® |
|---|---|---|---|
| ΔWI CIE (after 5 wash cycles) | −6.3 | −8.1 | −27.7 |

Table 4 shows the whiteness maintenance values for Tide® Original Scent HE, composition F of the present disclosure (see Table 2), and Seventh Generation® Lavender & Blue Eucalyptus Natural Laundry Detergent on new, white 50% cotton/50% polyester knit.

Example 4

Chlorine Scavenging Test Data from Liquid Laundry Detergent Compositions

A 2.4 ppm aqueous chlorine solution was prepared by combining 0.04 mL of sodium hypochlorite (Clorox bleach, 6% active) with 1 L of deionized water. This solution is divided into 0.25 L aliquots. Each test detergent is thoroughly mixed with each aqueous chlorine solution at a concentration representative of a front loading washing machine condition (0.60 g of detergent per 0.25 L of chlorinated water). The ability of each detergent to scavenge free chlorine is measured according to the instructions of the free chlorine testing kit, CHEMets® Kit K-2505, where the free chlorine remaining (FCR) for each test detergent is measured. The chlorine scavenging efficiency (CSE) of each detergent is calculated as follows:

$$CSE = \frac{(2.4 - FCR)}{2.4} \times 100$$

Formulations Tested: Formulations G, H, I, and J each contained identical concentrations of raw materials, with the following exceptions: formulation G contained 2.5% amine oxide, 0.45% DTPA, 1.5% ethoxylated polyethyleneimine, and 1.3% amphiphilic alkoxylated grease cleaning polymer; formulation H did not contain amine oxide, DTPA, ethoxylated polyethyleneimine, or amphiphilic alkoxylated grease cleaning polymer; formulation I did not contain amine oxide, DTPA, or amphiphilic alkoxylated grease cleaning polymer and did contain 1.5% ethoxylated polyethyleneimine; formulation J did not contain amine oxide, DTPA, or ethoxylated polyethyleneimine and did contain 1.3% amphiphilic alkoxylated grease cleaning polymer.

TABLE 5

| Raw Material | G | H | I | J |
|---|---|---|---|---|
| NI 24-9 | X | X | X | X |
| Amine oxide | 2.5 | — | — | — |
| SLE1S | X | X | X | X |
| Citric Acid | X | X | X | X |
| C12-18 Fatty acid | X | X | X | X |
| DTPA[3] | 0.45% | — | — | — |
| Protease | X | X | X | X |
| Amylase | X | X | X | X |
| Sodium tetraborate | X | X | X | X |
| Calcium Formate | X | X | X | X |
| Sodium Formate | X | X | X | X |
| Ethoxylated Polyethyleneimine[1] | 1.5 | — | 1.5 | — |
| Amphiphilic alkoxylated grease cleaning polymer[2] | 1.3 | — | — | 1.3 |
| Sorbitol | X | X | X | X |
| Ethanol | X | X | X | X |
| Propylene glycol | X | X | X | X |

TABLE 5-continued

| Raw Material | G | H | I | J |
|---|---|---|---|---|
| NaOH | X | X | X | X |
| Perfume | X | X | X | X |
| Water (balance) | — | — | — | — |

4. Polyethyleneimine (MW=600) with 20 ethoxylate groups per —NH.
5. Amphiphilic alkoxylated grease cleaning polymer is a polyethyleneimine (MW=600) with 24 ethoxylate groups per —NH and 16 propoxylate groups per —NH.
6. DTPA is diethylenetetraamine pentaacetic acid, a chelant, from Dow Chemical, Midland, Mich., USA Results:

TABLE 6

| | G | H | I | J | Seventh Generation ®[1] |
|---|---|---|---|---|---|
| Free Chlorine Remaining; FCR (ppm) | 0.0 | 1.9 | 0.0 | 0.10 | 1.9 |
| Chlorine Scavenging Efficiency; CSE (%) | 100% | 21% | 100% | 96% | 21% |

[1]See Table 2 for composition.

These results illustrate that compositions containing one or more alkoxylated polyethyleneimine polymers and biobased alkyl ether sulfate, and being substantially free of monoethanolamine, are able to remove greater than or equal to 96% of free chlorine from a wash solution, while known eco-friendly compositions are able to remove only 21% of free chlorine. Free chlorine in wash solution has been shown to cause fading of colors over multiple wash cycles; the ability to remove free chlorine from the wash solution may help maintain the color and extend the life of colored fabrics.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising: from about 1% to about 15% by weight of fatty alcohol ethoxylate of formula $R^2$—$(OCH_2CH_2)_y$—OH, wherein $R^2$ is a non-petroleum derived, linear or branched fatty alcohol consisting of even numbered carbon chain lengths of from about $C_{10}$ to about $C_{18}$, and wherein y is from about 0.5 to about 15;

citric acid;

from about 1% to about 15% by weight of a solvent comprising 1,2-propanediol; a polyhydric alcohol selected from the group consisting of 2,3-butanediol, 2,3-pentanediol, 2,4-pentanediol, 1,2-butanediol, 2,3-hexanediol, 1,5-pentanediol, and mixtures thereof; and water.

2. The laundry detergent composition of claim 1, wherein the laundry detergent composition further comprises from about 1% to about 20% by weight of linear or branched alkyl benzene sulfonates.

3. The laundry detergent composition of claim 1, wherein the laundry detergent composition further comprises from about 0.1% to about 5% by weight of amine oxide.

4. The laundry detergent composition of claim 1, wherein the laundry detergent composition is substantially free of dye and brightener.

5. The laundry detergent composition of claim 1, wherein the laundry detergent composition further comprises Natural Extracts, essential oils, or mixtures thereof.

6. The laundry detergent composition of claim 1, wherein the laundry detergent composition further comprises NaOH.

7. The laundry detergent composition of claim 1, wherein the laundry detergent composition is transparent.

8. The laundry detergent composition of claim 1, wherein the laundry detergent composition comprises of greater than 50% biobased materials.

9. The laundry detergent composition of claim 1, wherein the laundry detergent composition consists of ten components or less.

10. A laundry detergent composition comprising: from about 1% to about 15% by weight of fatty alcohol ethoxylate of formula $R^2$—$(OCH_2CH_2)_y$—OH, wherein $R^2$ is a non-petroleum derived, linear or branched fatty alcohol consisting of even numbered carbon chain lengths of from about $C_{10}$ to about $C_{18}$, and wherein y is from about 0.5 to about 15;

an citric acid;

from about 1% to about 15% by weight of an organic solvent comprising 1,2-propanediol; a polyhydric alcohol selected from the group consisting of 2,3-butanediol, 2,3-pentanediol, 2,4-pentanediol, 1,2-butanediol, 2,3-hexanediol, 1,5-pentanediol, and mixtures thereof; and water;

wherein the ratio of organic solvent to fatty alcohol ethoxylate is between 1:10 and 1:1.

11. The laundry detergent composition of claim 10, wherein the laundry detergent composition further comprises from about 1% to about 20% by weight of linear or branched alkyl benzene sulfonates.

12. The laundry detergent composition of claim 10, wherein the laundry detergent composition further comprises from about 0.1% to about 5% by weight of amine oxide.

13. The laundry detergent composition of claim 10, wherein the laundry detergent composition is substantially free of dye and brightener.

14. The laundry detergent composition of claim 10, wherein the laundry detergent composition further comprises Natural Extracts, essential oils, or mixtures thereof.

15. The laundry detergent composition of claim 10, wherein the laundry detergent composition further comprises NaOH.

16. The laundry detergent composition of claim 10, wherein the laundry detergent composition is translucent.

17. The laundry detergent composition of claim 10, wherein the laundry detergent composition consists of up to ten components.

18. The laundry detergent composition of claim 10, wherein the laundry detergent composition comprises of greater than 50% biobased materials.

19. The laundry detergent composition of claim 1, wherein the laundry detergent composition further comprises boric acid, lactic acid, or a combination thereof.

20. The laundry detergent composition of claim 10, wherein the laundry detergent composition further comprises boric acid, lactic acid, or a combination thereof.

* * * * *